US007367565B2

(12) United States Patent
Chiu

(10) Patent No.: US 7,367,565 B2
(45) Date of Patent: May 6, 2008

(54) BALANCE PLATE INTELLIGENT GAME APPARATUS

(76) Inventor: I-Cheng Chiu, 9F, No. 70 Sec. 5. Nan-King East Rd., Taipei (TW)

( * ) Notice: Subject to any disclaimer, the term of this patent is extended or adjusted under 35 U.S.C. 154(b) by 263 days.

(21) Appl. No.: 11/361,097

(22) Filed: Feb. 23, 2006

(65) Prior Publication Data

US 2007/0197315 A1 Aug. 23, 2007

(51) Int. Cl.
*A63F 7/00* (2006.01)
*A63F 9/06* (2006.01)
*A63F 9/26* (2006.01)

(52) U.S. Cl. ..... 273/449; 273/109; 273/112

(58) Field of Classification Search ..... 273/440, 273/449, 108, 109, 110, 112, 113, 118 R; 472/25, 26, 135

See application file for complete search history.

(56) References Cited

U.S. PATENT DOCUMENTS 3,188,087 A * 6/1965 Larson, Jr. ..... 273/115
3,811,676 A * 5/1974 Greenberg ..... 273/110
4,055,341 A * 10/1977 Martinez ..... 463/69
4,512,578 A * 4/1985 Dalton ..... 273/110
4,605,224 A * 8/1986 Torii ..... 482/146
6,019,712 A * 2/2000 Duncan ..... 482/110
6,419,586 B1 * 7/2002 Chiu ..... 472/25
6,485,018 B2 * 11/2002 Lorenz et al. ..... 273/110
7,011,308 B2 * 3/2006 Race ..... 273/110
2002/0008354 A1 * 1/2002 Lorenz et al. ..... 273/119 R
2005/0167909 A1 * 8/2005 Race ..... 273/110

* cited by examiner

*Primary Examiner*—Raleigh W. Chiu
(74) *Attorney, Agent, or Firm*—Pro-Techtor Int'l Services

(57) ABSTRACT

A balance plate intelligent game apparatus, structured to include a lower tier balance plate having a circular arc-shaped bottom portion and a transparent upper tier ball disk combined with a transparent top cover. A ball is disposed interior of the game apparatus so that when a young child treads on the balance plate with both feet and swings his body left and right, the ball is caused to roll into a helical groove of the upper tier ball disk from a helical groove of the lower tier balance plate, the ball then falls into a hole located center of the helical groove of the ball disk and drops into the helical groove of the lower tier balance plate, thereby enabling the ball to continuously roll between the upper and lower tiers.

4 Claims, 3 Drawing Sheets

BALANCE PLATE INTELLIGENT GAME APPARATUS

BACKGROUND OF THE INVENTION (a) Field of the Invention

The present invention relates to a balance plate intelligent game apparatus that enables both feet to tread on a balance plate, and left and right swinging of the body causes a ball to continuously roll within two tiered helical tracks.

(b) Description of the Prior Art

A ball disk of a conventional balance plate game apparatus is only provided with a single tier structure and a helical groove track within the ball disk only enables a ball to roll within the single tier track, and is thus only provided with a simple balance function that lacks any other purpose.

SUMMARY OF THE INVENTION

A primary objective of the present invention is to provide a lower tier balance plate and an upper tier ball disk each with a helical groove, thereby forming upper and lower tier track grooves therein, with a hole forming an interlink between the upper and lower track grooves. With such a configuration, a ball is able to roll from the lower tier helical track to the upper helical track, and then drop into the hole of the upper tier and enter a falling ball area of the lower tier track. When a young child treads on the balance plate, a swinging movement of his body causes the ball to continuously roll within the upper and lower track grooves, thereby training movement of the limbs and trunk to control balance and eye and feet coordination.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
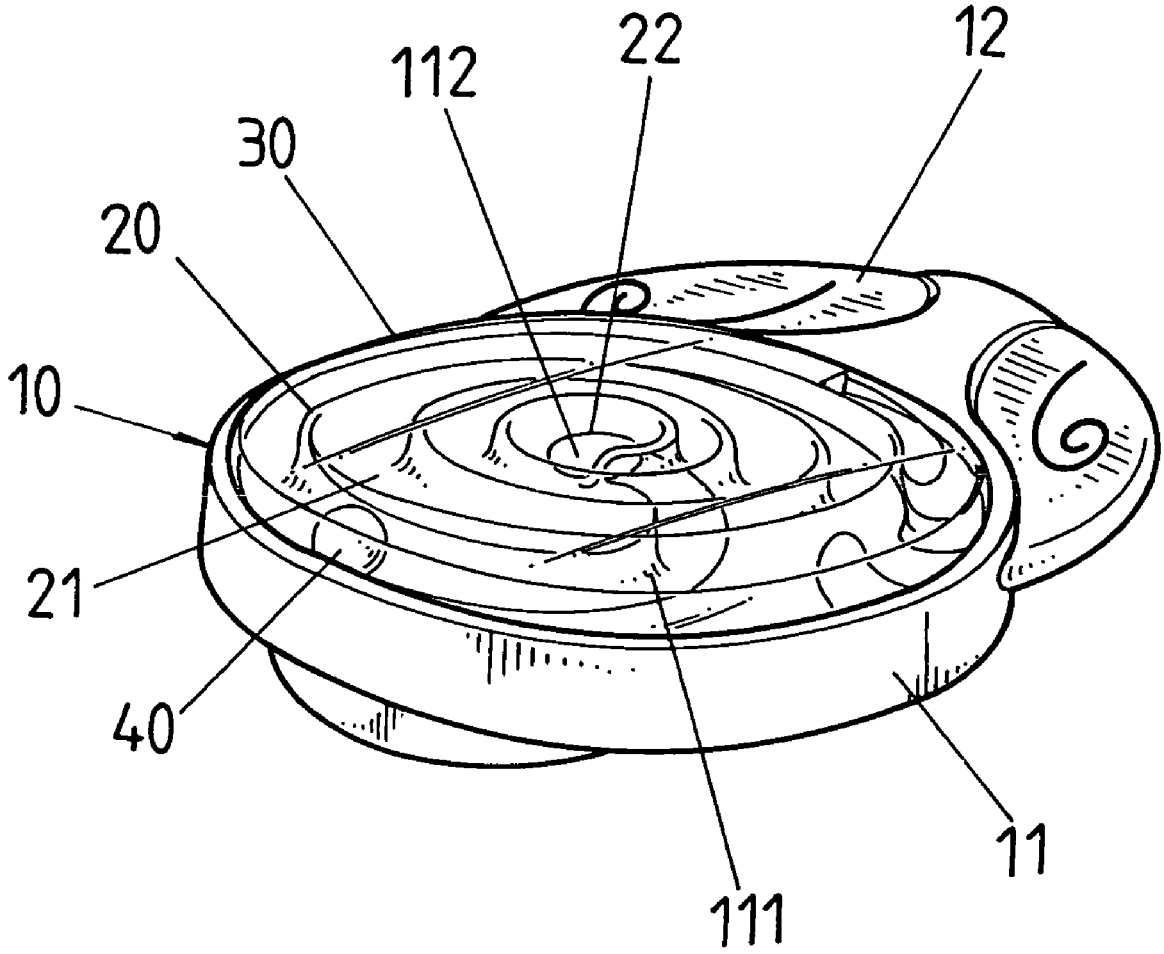
FIG. 1 shows a schematic external appearance of the present invention.
Figure 2:
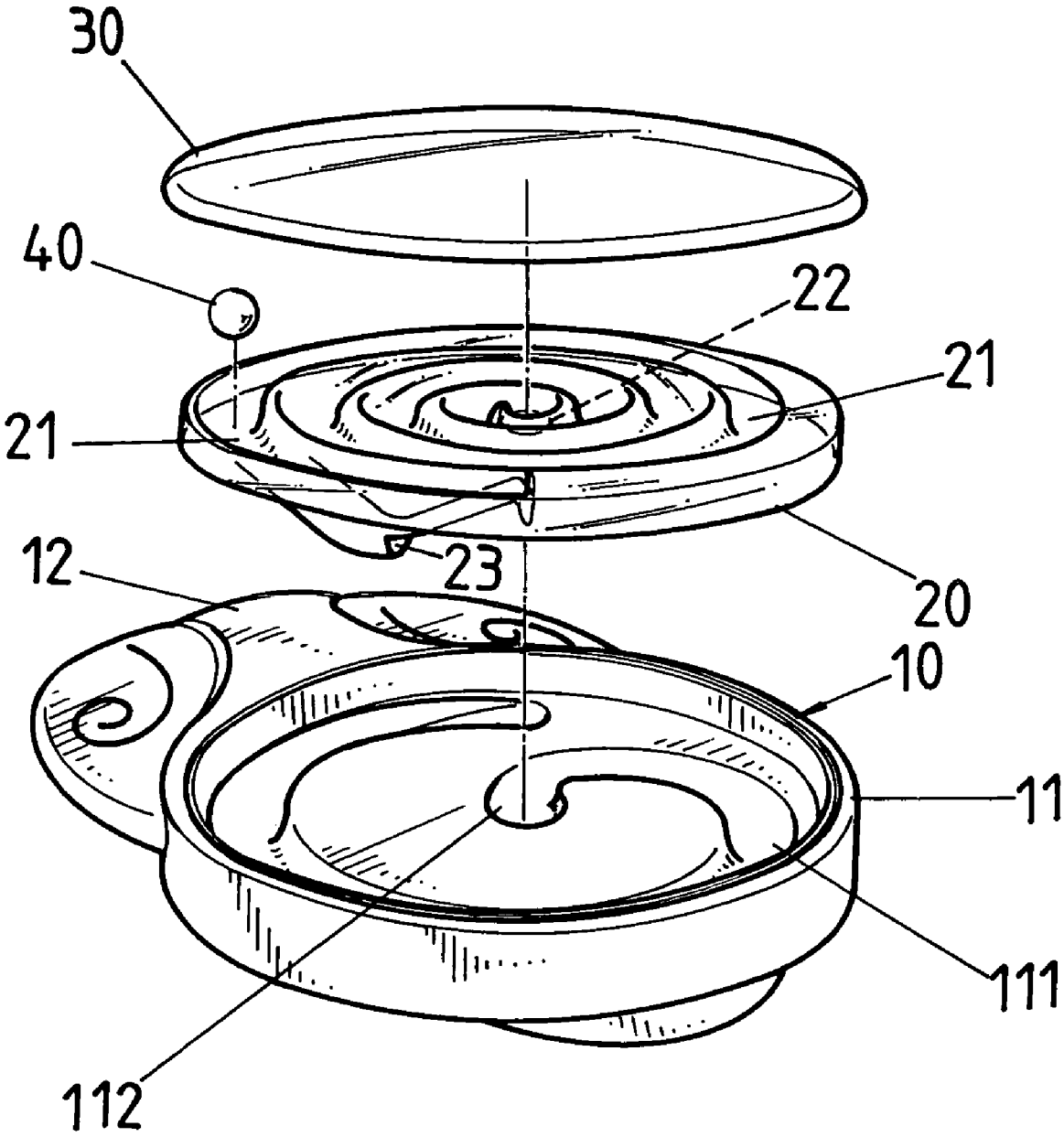
FIG. 2 shows an exploded schematic view according to the present invention.

Referring to FIGS. 1 and 2, which show a game apparatus of the present invention structured to comprise a balance plate 10, a ball disk 20, an upper cover 30 and a ball 40. Interior of a disk portion 11 of one end of the lower tier balance plate 10 is provided with a helical groove 111, and a falling ball area 112 of the groove 111 is formed at a center of the disk portion 11. A tread portion 12 of another end of the balance plate 10 enables both feet to tread thereon. Because a bottom portion of the balance plate 10 has a circular arc-shaped structure, thus, when both feet tread on the balance plate 10, left and right swinging of the body is able to cause a ball 40 to roll within the helical groove 111.

A transparent upper tier ball disk 20 is installed on the lower tier balance plate 10, and a helical groove 21 is formed on the ball disk 20. A hole 22 is defined at a center of the groove 21, and an inclined indentation 23 is formed in an outer side of the groove 21. A transparent top cover 30 further covers an upper portion of the ball disk 20, which prevents the ball 40 falling out from the ball disk 20. The transparent structural design of the top cover 30 and the ball disk 20 enables an operator to see the ball 40 for the purpose of controlling rolling of the ball 40.

Figure 3:
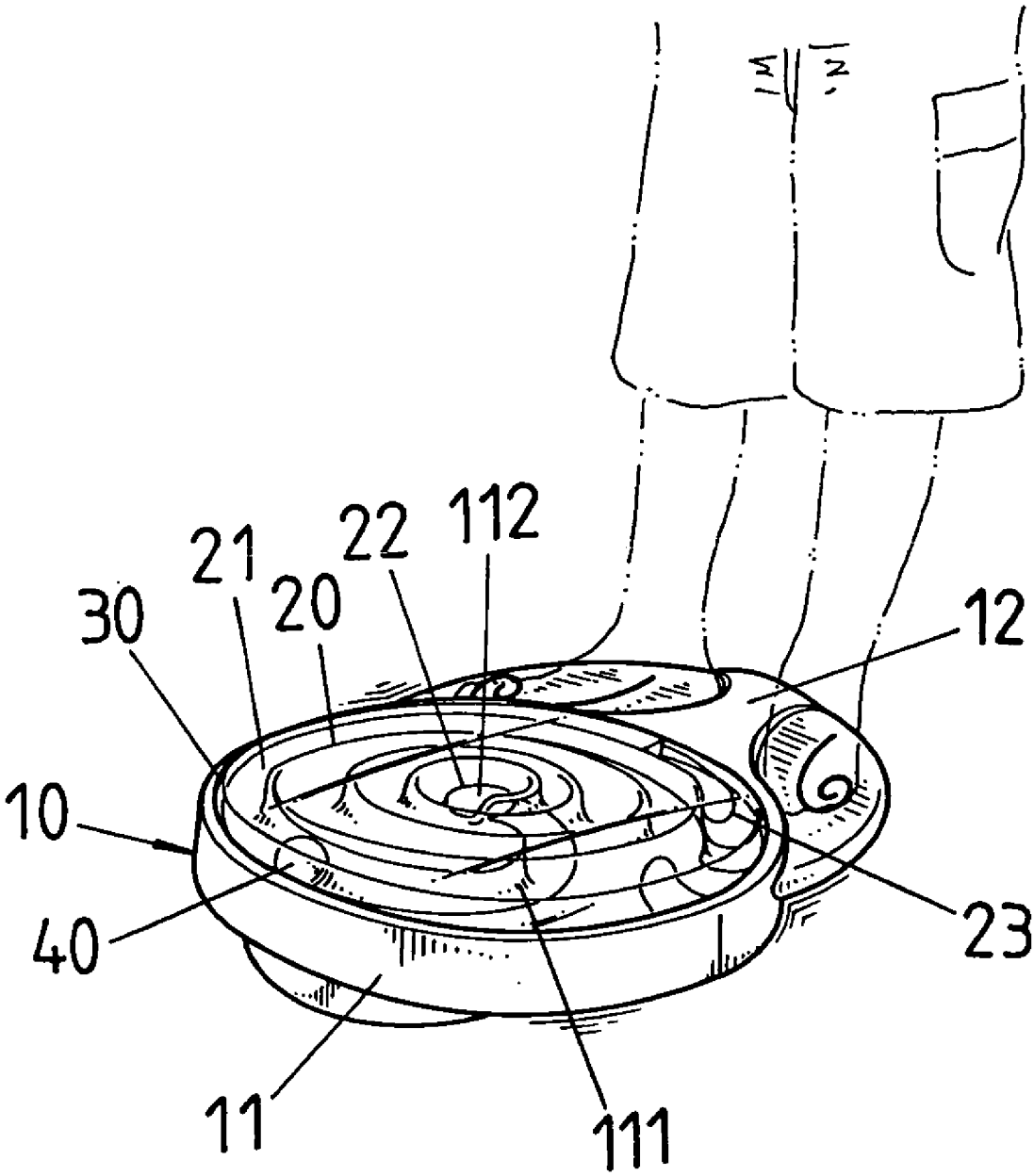
FIG. 3 shows a schematic view of an embodiment according to the present invention.

Referring to FIG. 3, after uncovering the top cover 30, the ball 40 is dropped into the hole 22 located center of the ball disk 20 and falls into the falling ball area 112 of the balance plate 10, thereby entering the groove 111. A young child treads on the balance plate 10 with his two feet and swings his body left and right, thereby causing the ball 40 to roll within the helical groove 111. When the ball 40 reaches the indentation 23 positioned at an end of the ball disk 20, it enters the groove 21 of the ball disk 20 and continues to roll. When the ball 40 has rolled to the hole 22 located center of the ball disk 20, it falls into the falling ball area 112 of the balance plate 10 and reenters the helical groove 111. In such a manner the ball 40 repeatedly rolls between the upper tier and lower tier helical tracks, thereby training the sense of balance of a child by moving the limbs and trunk to control balance and through feet and eye coordination.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A balance plate intelligent game apparatus comprising:

a balance plate, an interior of a disk portion of one end of the balance plate is provided with a helical groove, a tread portion of another end of the balance plate enables both feet to tread thereon, and a falling ball area is formed at a center of the groove;

a ball disk installed on the balance plate, a helical groove is formed in the ball disk, and a hole is defined at a center of the groove that interconnects with the falling ball area located center of the groove of the balance plate, an indentation is formed in an outer side of the groove that interconnects with the groove of the balance plate; moreover, a ball is positioned so as to roll within the grooves of the balance plate and the ball disk;

the aforementioned ball is able to fall into the falling ball area located center of the groove of the lower tier balance plate, and left and right swinging of the body enables the ball to roll into the indentation of the upper tier ball disk from the groove of the lower tier balance plate, thereby enabling the ball to reenter and again roll within the groove of the upper tier ball disk.

2. The balance plate intelligent game apparatus according to claim 1, wherein a transparent top cover covers an upper portion of the ball disk, which prevents the ball falling out from the ball disk.

3. The balance plate intelligent game apparatus according to claim 1, wherein a bottom portion of the balance plate is a circular arc-shaped structure.

4. The balance plate intelligent game apparatus according to claim 1, wherein the ball disk is a transparent structure.

* * * * *